United States Patent [19]

Beattie et al.

[11] Patent Number: 5,009,090

[45] Date of Patent: Apr. 23, 1991

[54] COMBINATION LOCK ASSEMBLY

[75] Inventors: Patrick J. Beattie, West Henrietta; Andrew L. Oliveri; Richard J. Sylvester, both of Rochester, all of N.Y.

[73] Assignee: John D. Brush & Co., Inc., Rochester, N.Y.

[21] Appl. No.: 459,451

[22] Filed: Jan. 2, 1990

[51] Int. Cl.[5] ..... E05B 15/14

[52] U.S. Cl. ..... 70/326; 70/323; 70/302

[58] Field of Search ..... 70/302, 303 R, 303 A, 70/323, 326, 327, 328, 329

[56] References Cited

U.S. PATENT DOCUMENTS

| | | | |
|---|---|---|---|
| 2,047,102 | 7/1936 | Hite | 70/303 A |
| 2,775,113 | 12/1956 | Behrens . | |
| 2,775,115 | 12/1956 | Bremer | 70/303 A |
| 2,779,185 | 1/1957 | Papini . | |
| 2,925,726 | 2/1960 | Miller . | |
| 3,180,119 | 4/1965 | Goldfarb . | |
| 3,423,970 | 1/1969 | Harrell | 70/303 R |
| 4,376,380 | 3/1983 | Burgess . | |
| 4,512,167 | 4/1985 | Remenicky . | |
| 4,628,715 | 12/1986 | Uyeda et al. . | |
| 4,796,446 | 1/1989 | Miller et al. . | |

*Primary Examiner*—Robert L. Wolfe

*Attorney, Agent, or Firm*—Eugene Stephens & Associates

[57] ABSTRACT

A combination lock assembly for safes in which the combination can be easily reset without dismantling the assembly or changing its original adjustment for smoothness and consistency of tumbler wheel motion. The tumbler wheel and spacing washer components of the assembly are all mounted on a bushing that also includes an end cap. The tumblers and spacers are spring biased by a wave washer so that the drive tumbler, which includes a plurality of angularly spaced holes, presses against the end cap. One of the holes is aligned with a drive stud on the drive cam that is used to position the tumblers. In the event the drive tumbler should receive uneven pressure from the drive studs (e.g., due to improper alignment of the safe's drive spindle), the tumbler wheels and washers are all held together by the bias of the wave washer and are maintained with their engagement surfaces parallel with each other, permitting proper operation without undesirable wear. To reset the combination, manual pressure of the drive tumbler is sufficient to overcome the bias of the wave washer to move the tumblers and washers axially away from the end cap. This movement allows the drive tumbler to be rotated relative to the drive cam so that another of said angularly spaced holes is aligned with the drive stud. This simple procedure changes the combination required to open the safe.

15 Claims, 3 Drawing Sheets

COMBINATION LOCK ASSEMBLY

BACKGROUND

Security enclosures such as safes, strong boxes, and the like use combination locks which mount on an inside wall of the safe and have tumbler wheels with peripheral gate notches that must be aligned in order to be opened. The tumbler wheels are positioned by a driver fixed to a spindle which is rotated by the turning of a dial mounted on the outside of the safe. These tumbler wheels, along with other components of such locks, e.g., spacing washers, retaining nuts, etc., are supported on a bushing bolted to a mounting plate that attaches to the inner wall of the safe. Usually, these components are assembled at the time the lock is installed in the safe, and the installer must take special care to assure that the tumblers, while being readily movable, are not too loose and that their movement is smooth and consistent. However, with safes having heavy steel walls, it is not unusual to have slight misalignment problems between the spindle holes in the inner and outer walls. These alignment problems can cause the spindle to be canted in relation to the inner wall, i.e., not perpendicular to the surface of the inner wall; and this in turn makes it difficult to line up the cam driver or drive tumbler (fixed to the spindle) with the other lock components. This misalignment can cause stiffness in the movement of the lock components and/or can place uneven pressure on the tumbler wheels, moving them out of their parallel relationship and resulting in "skipping or dragging" during tumbler wheel movements.

For security reasons, it sometimes becomes desirable or necessary to change the combinations of such locks. This requires that changes be made to the tumbler wheels and/or to the drivers which position said tumbler wheels. Since such changes often require that the combination locks be dismantled and rebuilt with new or adjusted tumbler wheels, drivers, etc., such changes are usually relatively difficult, time consuming, and expensive.

We have invented a novel combination lock assembly that is relatively inexpensive, simple to assemble, and easily reset to any one of a plurality of combinations. Such resetting does not require the services of a professional lock expert but can be readily accomplished by the safe owner. Further, the tumbler wheels of our combination lock can be assembled in an independent assembly before being installed in a safe. This independent assembly can be tested, and the movement of the tumbler wheels can be adjusted for appropriate smoothness and consistency. This preinstallation adjustment of the assembly is not changed when the lock is installed. Further, in the event of spindle misalignment, as referred to above, the movement of our combination locks remains uniformly consistent because, even with uneven pressure on the drive tumbler wheel, the surfaces of all of the tumbler wheels remain parallel with each other so that they continue to interact smoothly and properly.

In one embodiment, this independent assembly of our combination lock incorporates a lock link and pin subassembly which can also be tested and adjusted prior to its installation in a smaller security enclosure such as strong box or hotel room safe.

Further, by virtue of this independent assembly feature of our invention, the security of the lock is increased. That is, since the tumbler wheel assembly is independent of the dial/spindle/driver mechanism, if the dial should be broken off and the spindle be punched out, the tumbler wheel assembly remains intact to prevent opening of the safe enclosure.

SUMMARY OF THE INVENTION

Our combination lock mounts the tumbler wheels, each separated from the next by a spacing washer, on the cylindrical bearing surface of a bushing which is integral with a mounting plate. This unitary bushing-/mounting plate structure is manufactured from a strong resin, e.g., polycarbonate. The mounting plate portion of the unitary structure is configured to cooperate with fasteners used to mount the lock assembly to a safe. The unitary structure has a passageway concentric with the bearing surface of the bushing for receiving a spindle that interconnects a dial mounted on an outside wall of the safe with a studded driver for rotating the tumbler wheels.

The bushing portion has an axial keyway, and each spacing washer is provided with a key that fits into this keyway to prevent rotation of the washer. The spacing washers are also manufactured from an appropriate resin, e.g., a mixture of nylon and molybdenum disulfide, to provide a frictional consistency as the zinc coated tumbler wheels rotate against them. These washers help to provide a desired smoothness in lock operation.

An end cap is fused to the outer end of the bushing, and a spring (in the form of a wave washer) biases the tumbler wheels and spacer washers away from the mounting plate portion of the unitary structure, causing the outermost (drive) tumbler wheel to press against this end cap. The drive tumbler wheel has a plurality of angularly spaced apertures which are designed to be engaged by the drive studs of the driver which is fixed to the end of the dial spindle.

As indicated above, this entire tumbler wheel assembly is supported on the bushing portion of the unitary resin structure, and it remains independent of the dial/-spindle/driver mechanism until installation in a safe. This independent assembly can be tested and adjusted prior to installation. However, the bias of the spring can be overcome to permit axial movement of the tumbler wheels and spacing washers away from the end cap so that, should the drive tumbler wheel receive uneven pressure from the drive cam studs, the entire stack of tumbler wheels and spacing washers can move together to maintain the required parallelism of their engaging surfaces.

Similarly, the bias of the spring can be overcome manually to move the drive tumbler wheel away from the end cap so that, after installation, it can be easily moved in this manner and disengaged from the driver which is fixed to the end of the dial spindle. When so disengaged, the drive tumbler wheel can then be simply rotated relative to the driver to align the drive studs with different ones of said angularly spaced apertures. When so aligned, the tumbler wheel can be released, allowing the bias of the spring to again engage it with the driver; and in this simple manner the combination of the lock is changed.

In another preferred embodiment, the bearing surface of the bushing is extended by a variation in the design of the end cap, and an additional component is supported on the bushing. Namely, a lock link and pin subassembly is made part of the independent assembly which can be tested and adjusted prior to installation.

DRAWINGS

DETAILED DESCRIPTION

Figure 2:
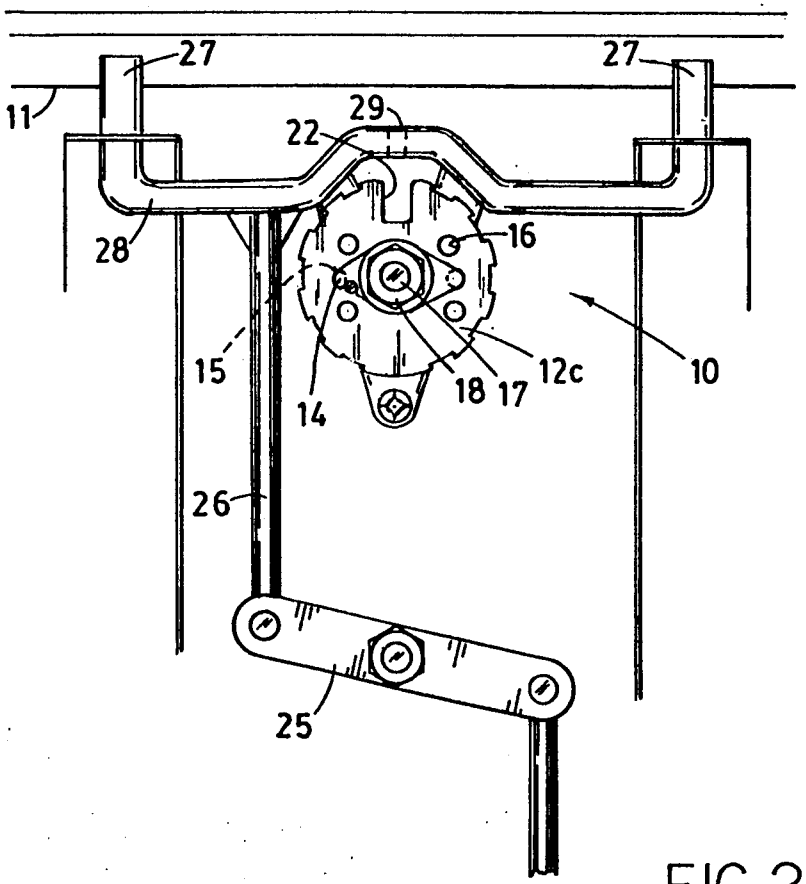
FIG. 2 is a view of the inside of the same safe door shown in FIG. 1 with door cover removed.
Figure 1:
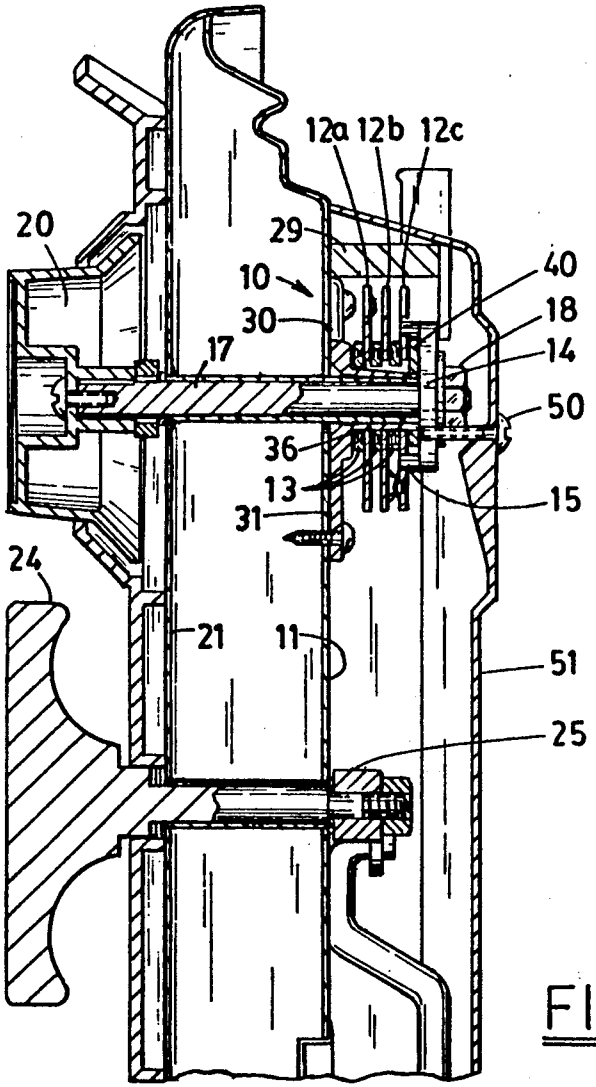
FIG. 1 is a cross-sectional view of a portion of a safe door on which are mounted a preferred embodiment of our combination lock including the independent tumbler wheel assembly and a dial/spindle/driver mechanism, as well as a live bolt assembly and handle.

Referring to FIGS. 1 and 2, a combination lock assembly 10 according to our invention is shown mounted to an inside wall 11 of a safe. Assembly 10 includes three tumbler wheels 12*a*, 12*b*, and 12*c* separated by spacing washers 13. A drive cam 14 has a pair of drive studs 15 which engage two of several holes 16 angularly spaced in drive tumbler wheel 12*c*.

Drive cam 14 is splined to spindle 17, being held in place by a nut 18. Spindle 17 is in turn splined to a dial 20 mounted on an outer wall 21 of the safe. In a manner well known in the art, appropriate clockwise and counterclockwise rotation of dial 20 causes a similar rotation of driver 14 to move tumbler wheels 12*a*, 12*b*, and 12*c* until their respective gate notches 22 are all aligned as shown in FIG. 2.

When the gate notches of the tumbler wheels are so aligned, a handle 24, also mounted on outer wall 21, can be turned to open the safe. That is, when handle 24 is turned, it rotates a T-bar 25 which moves a connecting rod 26 to pull out a pair of live bolts 27 carried by a bracket 28. Such movement of live bolts 27 is only possible when gate notches 22 of the tumbler wheels are aligned as shown in FIG. 2 so that they do not block lock projection 29 which is also carried on bracket 28.

Figure 3:
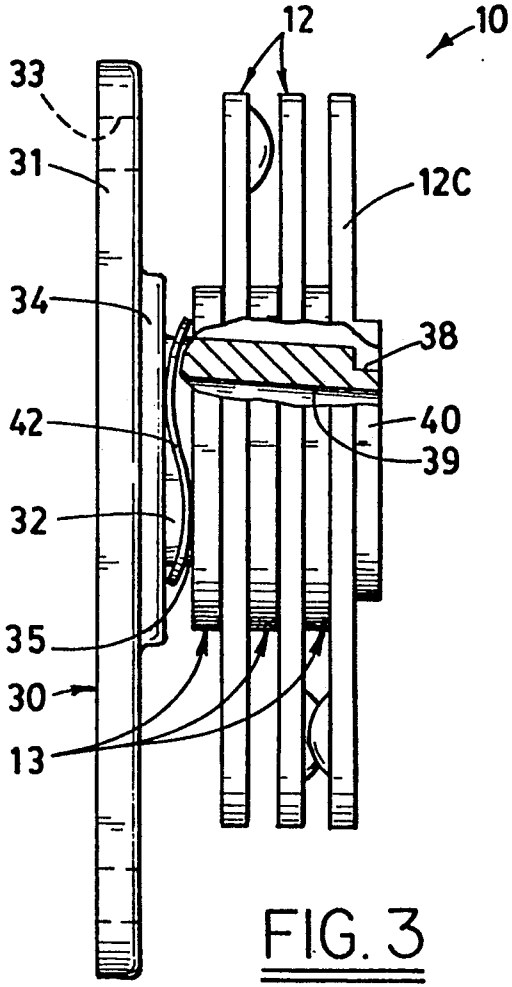

Combination lock assembly 10 is an independent assembly which is carried by an integral structure 30 seen best in the enlarged view of FIG. 3. Structure 30 is made from a strong resin, e.g., polycarbonate, and has a mounting plate portion 31 and a bushing portion 32. Mounting plate portion 31 is configured to receive fasteners for attaching the assembly to a safe. In this preferred embodiment, holes 33 are provided for installing the assembly. Mounting plate portion 31 also has a shoulder 34 that surrounds bushing portion 32.

Bushing portion 32 has a cylindrical bearing surface 35 for supporting the tumbler wheels 12 and washers 13, and it has an axial keyway 36 which cooperates with keys 37 formed in the inner periphery of washers 13. A step 38 forms a pair of orthogonal surfaces in the outer end of bushing portion 32 for receiving a retainer in the form of an end cap 40 which is fused to both surfaces of step 38 for retaining all of the assembled components on the bushing. A lock spindle passageway 39, concentric with cylindrical bearing surface 35, goes completely through integral resin structure 30 and is used to receive the spindles of the drive assemblies which rotate the tumbler wheels mounted on bushing portion 32.

To reduce wear of the tumbler wheels 12 and to permit them to move with a desired smoothness and consistency, spacing washers 13 are also manufactured from a resin, e.g., a mixture of nylon and molybdenum disulfide; and their wear surfaces are contoured as a pair of concentric engagement surfaces surrounding a groove. With this design, push pins and sprues required for molding, are relegated to the groove, assuring maximum flatness of the wear surfaces; and warping is minimized during the shrinking that occurs following manufacture.

A spring in the form of wave washer 42 is mounted between shoulder 34 and the first spacing washer 13, and it biases the entire stack of tumbler wheels and washers away from mounting plate portion 31, pressing drive tumbler wheel 12*c* against end cap 40.

Figure 4:
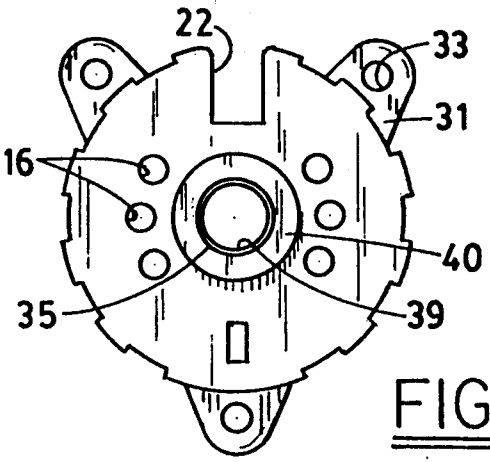
FIG. 3 and 4 are enlarged side and end views, respectively, of the independent tumbler wheel assembly shown in FIG. 1, with a partially cross-sectioned view (in FIG. 3) of a keyway and step formed in the bushing portion of the unitary mounting plate/bushing structure.
Figure 6:
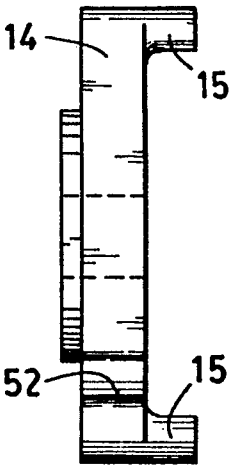
FIGS. 5 and 6 are plan and side views, respectively, of the cam driver in FIG. 1.
Figure 5:
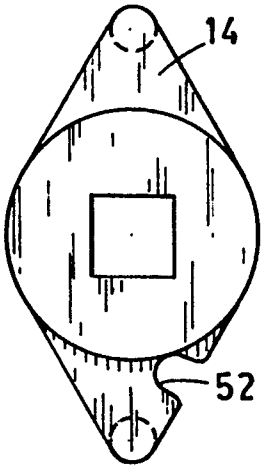

FIG. 4, an end view of the lock assembly shown in FIG. 3, shows an unencumbered view of angularly spaced holes 16 formed in drive tumbler wheel 12*c*. These apertures are engaged by drive studs 15 of drive cam 14 (shown in FIGS. 5 and 6).

Uneven pressure on drive tumbler wheel 12*c* by drive studs 15 (possibly due to a misalignment of spindle 17) can cause drive tumbler wheel 12*c* to be canted from its perpendicular relationship with bearing surface 35 of bushing 32. If this occurs, wave washer 42 continues to press the entire stack of tumbler wheels and spacing washers so that they remain pressed together, one against the other, with their respective engagement surfaces maintained parallel to each other. This permits the stacked tumbler wheels to continue to function properly and to maintain their designed smoothness and consistency of motion. This also prevents the undesirable wear that could otherwise result from a lack of parallelism.

Also, it is possible to manually press against drive tumbler wheel 12*c* and overcome the spring bias of wave washer 42 to move tumbler 12*c* away from end cap 40. This moves tumbler 12*c* out of engagement with drive studs 15. When so disengaged, tumbler 12*c* can be rotated relative to drive cam 14 to align a different pair of the holes 16 with drive studs 15. When tumbler 12*c* is released, wave washer 42 once again biases tumbler 12*c* against end cap 40 and brings drive studs 15 into engagement with these two different holes. This relative movement results in a change in the combination which brings gate notches 22 into alignment. Since there are three sets of holes, and since these holes can be aligned with studs 15 when gate notch 22 is the position shown or when gate notch 22 is oriented 180 degrees from the position shown, the assembly can be set for six different combinations with this preferred arrangement of drive studs and holes.

Figure 7:
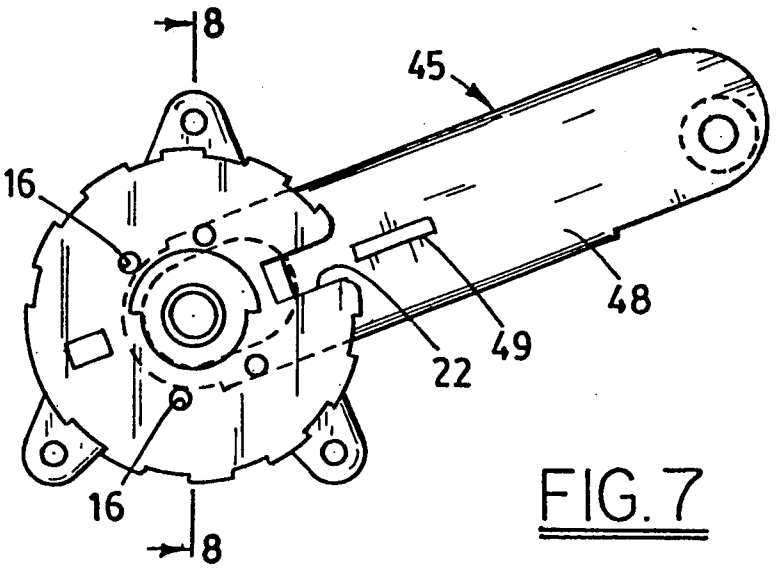
FIGS. 7 and 8 are views of another preferred embodiment of the invention, FIG. 8 being a cross section taken along line 8—8 in FIG. 7.
Figure 8:
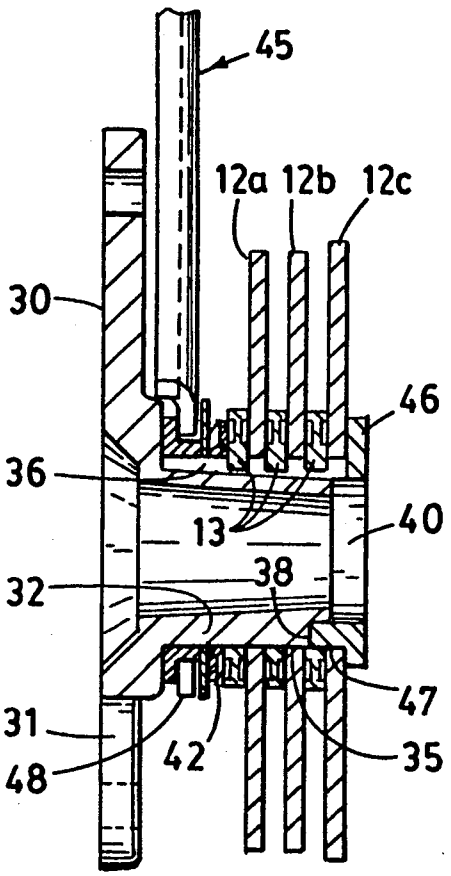

Another preferred embodiment of our combination lock is shown in FIGS. 7 and 8, the latter figure being a cross section taken along line 8—8 of FIG. 7. This lock assembly is used in a combination lock for a security enclosure such as a strong box or a hotel room safe. Again, integral resin structure 30 is used to support the various lock assembly components which, in this case again include tumbler wheels 12 and spacing washers 13. These components are mounted on the bearing surface of bushing portion 32, with washers 13 being keyed to axial keyway 36. In addition, a lock link and pin subassembly 45 is also supported on bushing 32 and is positioned between shoulder 34 of mounting plate portion 31 and the grouped tumbler wheels and washers.

To accommodate this additional subassembly 45, a different end cap 40' is used. Cap 40' is still fused to the orthogonal surfaces of step 38 at the outer end of bushing 31, but cap 40' is longer axially, and it has a retaining wall section 46 at is outer end. End cap 40' also has a cylindrical bearing surface 47 which is coextensive with cylindrical bearing surface 35 of bushing 32 and supports drive tumbler wheel 12c and a spacing washer 13.

A dial/spindle/driver assembly (not shown), similar to that illustrated in FIG. 1 and discussed above, is used to position the tumbler wheels 12. When gate notches 22 of tumbler wheels 12 are aligned as shown in FIG. 7 by proper operation of the safe combination, a handle (not shown) is turned to move lock link 48 to the left; and the movement link 48 permits the door of the safe to be opened. Extending perpendicular to the surface of lock link 48 is a lock projection 49 which can be moved into the aligned gate notches 22 but which blocks the opening movement of link 48 in the event the gate notches are not so aligned.

In this embodiment, wave washer 42 is positioned between lock link 48 and the first washer 13 in the tumbler wheel/washer stack and similarly biases drive tumbler wheel 12c against retaining wall 46 of end cap 40'. As with the previously described embodiment, it is still possible to manually overcome the spring bias of wave washer 42 to move drive tumbler wheel 12c away from retaining wall 46 so that it can be rotated relative to its related drive cam to change the combination of the lock in the manner described above. In this embodiment, drive tumbler 12c has only four angularly spaced holes 16, and these apertures can also be engaged with the drive studs of its cooperating drive cam when gate notch 22 of tumbler 12c is in the position shown or when it is rotated 180 degrees. This four hole arrangement provides four possible combinations for this assembly.

The simple resetting procedure described above does not affect the preadjusted smoothness and consistency of assembly 10 which is tested prior to the installation of the assembly in a safe.

Referring again to FIG. 1, a lockout member in the form of screw 50 is threaded through the cover 51 over the inside wall of the safe. Screw 50 is received into the recess 52 in one side of drive cam 14 (see FIGS. 5 and 6). Drive cam 14 is designed so that recess 52 is lined up with screw 50 when gate notches 22 of all of the tumblers are in alignment. If screw 50 is threaded all the way into cover 51 so that it engages recess 52, then combination assembly 10 is held fixed in this aligned position, and the door of the safe can be opened and closed at will without locking. This lockout feature is used when a safe is new and being demonstrated prior to sale, or it can be used at any time thereafter when access to the safe is wanted without fear of accidental locking.

We claim:

1. A combination lock assembly for installation in a safe or strong box, comprising:

an integrated resin structure with a mounting plate portion for receiving fasteners for installing the assembly and a bushing portion having a cylindrical bearing surface with an axial keyway and a step at its outer end;

a plurality of tumbler wheels, including a drive tumbler wheel, separated by a spacing washer between each, said drive tumbler wheel having a plurality of angularly spaced holes and all of said tumbler wheels and washers being supported on the bearing surface of said bushing portion;

a retaining cap fixed to the stepped end of said bushing portion;

a spring for biasing said tumbler wheels and washers away from said mounting plate portion so that said drive tumbler wheel is pressed against said retaining cap;

a lock spindle passageway through said mounting plate and bushing portions of said integrated structure;

a drive cam having a projecting drive stud; and a rotatable spindle positioned in said passageway and fixed to said drive cam so that said drive stud is received into one of the angularly spaced holes in said drive tumbler wheel;

the bias of said spring being predetermined to allow said tumbler wheels and washers to be moved together as a unit away from said retaining cap and back toward said mounting plate so that the surfaces of said tumbler wheels and washers remain substantially parallel relative to each other when so moved.

2. The combination lock according to claim 1 wherein said tumbler wheels and washers can be moved manually away from said retainer cap until said drive tumbler is disengaged from the projecting stud of said drive cam so that said drive cam can be rotated relative to said drive tumbler wheel to reposition its drive stud into engagement with a different one of said holes in said drive tumbler wheel.

3. The combination lock according to claim 1 wherein said washers are a resin material and said tumbler wheels are zinc coated.

4. The combination lock according to claim 1 wherein said spring is a wave washer.

5. The combination lock according to claim 1 wherein said integrated resin structure further comprises a raised shoulder surrounding said bushing portion at its intersection with said mounting plate portion.

6. The combination lock according to claim 1 wherein said spring, tumbler wheels, spacing washers, integrated resin structure, and retaining cap can all be initially assembled and tested as an assembly independent of said rotatable spindle and drive cam.

7. The combination lock according to claim 6 wherein said assembly can be installed in a safe independent of any fixed connection with said rotatable spindle and drive cam.

8. The combination lock according to claim 1 further comprising a removable lockout member for selectively preventing rotation of said tumbler wheels from a predetermined alignment position in which said lock is open.

9. The combination lock according to claim 8 wherein said drive cam has an opening for receiving said removable lockout member to prevent rotation of said drive cam.

10. The combination lock according to claim 8 further comprising a cover for said lock and wherein said removable lockout member is a screw threadable through said cover and into said opening in said drive cam.

11. The combination lock according to claim 1 wherein the bushing portion of said integrated structure has an axial keyway and each of said spacing washers has a key which cooperates with said keyway to prevent rotation of said washers.

12. The combination lock according to claim 1 further comprising a lock link and pin subassembly supported on said bushing between said mounting plate portion and said tumbler wheels, and wherein said retaining cap has a raised retaining wall at its outer end and a cylindrical bearing surface which is coextensive with the bearing surface of the cylindrical bushing portion of said integral structure.

13. In a combination lock having a plurality of tumbler wheels, including a drive tumbler wheel, separated by spacing washers and each having a peripheral gate notch, a rotatable spindle fixed to a drive cam with a drive stud for turning said tumbler wheels, the improvement wherein:

said tumbler wheels and spacing washers are supported on the bearing surface of a cylindrical bushing;

a retainer fixed to the outer end of said bushing;

a spring biasing said tumbler wheels and spacers so that the drive tumbler wheel is pressed against said retainer, said spring being compressible to allow said tumbler wheels and washers to be moved axially along said bearing surface away from said retainer;

said drive tumbler wheel having a plurality of angularly spaced apertures for receiving the drive stud of said drive cam; and said cylindrical bushing, spring, tumbler wheels, spacing washers, and retainer being independent from said spindle and drive cam to permit said tumbler wheels and washers to be moved away from said retainer and rotated relative to said drive cam so that said drive stud can be received by a different one of said angularly spaced apertures.

14. The combination lock improvement of claim 13 further comprising a selectively removable lockout member for holding said tumbler wheels in a predetermined orientation with their respective gate notches aligned, and wherein said drive cam also includes an opening for receiving said lockout manner.

15. The combination lock improvement of claim 13 wherein said drive tumbler wheel has four angularly spaced apertures and said drive cam has a pair of drive studs.

* * * * *